United States Patent [19]

Dickie

[11] Patent Number: 5,002,188

[45] Date of Patent: Mar. 26, 1991

[54] COLLAPSIBLE PROTECTIVE CARTON WITH INTERIOR CRADLE

[75] Inventor: Robert G. Dickie, Newmarket, Canada

[73] Assignee: Intepac Technologies, Inc. (Ontario Canada), Markham, Canada

[21] Appl. No.: 548,325

[22] Filed: Jul. 3, 1990

[51] Int. Cl.[5] ..... B65D 5/48; B65D 81/02

[52] U.S. Cl. ..... 206/589; 206/45.14; 229/120.21

[58] Field of Search ..... 206/44 R, 45.14, 45.19, 206/583, 588, 589; 229/120.11, 120.12, 120.18, 120.21

[56] References Cited

U.S. PATENT DOCUMENTS

| | | | |
|---|---|---|---|
| 2,128,197 | 8/1938 | Weil | 206/45.14 |
| 2,654,469 | 10/1953 | Fulmer et al. | 206/45.19 |
| 2,764,337 | 9/1956 | Bolding | 229/38 |
| 2,841,320 | 7/1958 | Currivan | 229/39 |
| 3,115,290 | 12/1963 | Byassee | 229/39 |
| 3,217,960 | 11/1965 | Davis | 229/39 |
| 3,791,571 | 2/1974 | Pilz, III | 229/40 |
| 4,113,096 | 9/1978 | Scott | 206/523 |
| 4,200,188 | 4/1980 | Webinger | 206/45.14 |
| 4,313,541 | 2/1982 | Hart et al. | 206/588 |
| 4,360,145 | 11/1982 | Wilcox | 229/1.5 R |
| 4,373,626 | 2/1983 | Roccaforte | 206/45.14 |
| 4,415,078 | 11/1983 | Hart | 206/45.14 |
| 4,498,580 | 2/1985 | Getz et al. | 206/45.14 |

FOREIGN PATENT DOCUMENTS

| | | | |
|---|---|---|---|
| 1262021 | 4/1961 | France | 206/45.19 |
| 0540280 | 10/1941 | United Kingdom | 206/45.19 |

*Primary Examiner*—Jimmy G. Foster

*Attorney, Agent, or Firm*—Robert O. Nimtz

[57] ABSTRACT

A collapsible protective carton of corrugated cardboard is constructed from either one or two blanks and contains a suspended product protecting cradle dividing the carton interior into upper, lower, and central compartments. The central compartment is the primary product holding compartment, while the upper and lower compartments provide both protection against crushing and potential additional storage space for flat items such as instruction manuals or computer disks. At each end of the carton, a diagonal web member assists in locating the product in the center of the carton and provides additional protection against blows or pressure upon either end of the assembled carton. Cut-outs in two of the panels defining the central compartment serve not only to help position the central compartment within the outer carton but also to weaken those panels sufficiently to permit light products to deform the diagonal web members more readily if the carton should be dropped.

11 Claims, 1 Drawing Sheet

11

COLLAPSIBLE PROTECTIVE CARTON WITH INTERIOR CRADLE

TECHNICAL FIELD

This invention relates generally to collapsible cartons and more particularly to collapsible cartons with inner portions which provide a protective cradle for shipping light weight but fragile products.

BACKGROUND OF THE INVENTION

When shipping small and light weight but fragile products, it is desirable to provide protection which is as complete as possible and, at the same time, minimize both packaging and shipping costs. Corrugated cardboard or its functional equivalent is commonly used for the outer panels of the carton. To provide extra light weight protection, either additional cardboard sections or foam inserts or both are commonly used inside of the outer carton panels. Extra inserts of a different material add to packaging costs, though, and additional cardboard sections have typically needed to be glued in place, also adding to packaging costs. The present invention avoids any need to use either foam inserts or glue and does so, moreover, in a manner which provides both good stacking strength and good crush resistance for the assembled carton.

SUMMARY OF THE INVENTION

The invention generally takes the form of a collapsible carton of substantially rectangular cross section including outer walls and a product cradle supported within the outer walls, defining upper, central, and lower compartments within the assembled carton, with diagonal web members at both ends of the assembled carton both to position the cradle and provide additional structural strength. The central compartment is the principal product supporting compartment of the cradle, although either of the remaining compartments may be used to enclose products as well. In particular, the carton is formed from a blank comprising a succession of at least four parallel outer wall panels separated by longitudinal fold lines and from either a continuation of the same blank or from another blank comprising a succession of at least five parallel cradle panels separated by longitudinal fold lines.

From one aspect of the invention, one of the cradle panels contains lateral cut-outs adapted to provide the diagonal web members at both ends of the carton. From another aspect of the invention, at least two of the cradle panels contain longitudinal cut-outs and have portions of their respective fold lines displaced from the rest at the longitudinal cut-outs, not only enabling the cradle panels to define the upper, central, and lower cradle compartments but also weakening those same two cradle panels sufficiently to permit a light product contained in the central compartment of the assembled carton to deform the diagonal web members if the carton should ever be dropped.

From the first mentioned aspect of the invention, of the cradle panels just described, a first is a lap panel adjacent to one of the outer wall panels upon assembly, a second is a product supporting panel adjacent to the first cradle panel, a third is a lap panel adjacent to the second cradle panel, a fourth is a product supporting panel adjacent to the third cradle panel, the fifth is a lap panel adjacent to the fourth cradle panel, a selected one of the second and fourth cradle panels has a pair of lateral cut-outs running parallel to each other at predetermined distances from opposite ends of the panel, and the fold line portions extending from each of the lateral cut-outs to the ends of the cradle panel containing them are displaced in the same direction from but are substantially parallel to the remaining portions of those same fold lines. In this manner, the end portions of the selected cradle panel are made to form substantially diagonal web members at both ends of the carton in its assembled form.

From the other aspect of the invention mentioned above, of the cradle panels described, the second contains longitudinal cut-outs extending parallel and adjacent to both of its fold lines, portions of both fold lines of the second cradle panel extending between the longitudinal cut-outs are displaced in opposite directions from one another and are parallel to the remaining portions of the fold lines, the fourth contains longitudinal cut-outs extending parallel and adjacent to one of its fold lines, and portions of that fold line of the fourth cradle panel are displaced from and parallel to the remaining portions of that fold line. In this manner, the second and fourth cradle panels are not only made to define the upper, central, and lower compartments of the cradle but also weakened sufficiently to permit ready deformation of the diagonal web members for purposes of energy absorption.

Because the collapsible carton of the present invention is constructed from only one or two pieces of corrugated cardboard, initial fabrication costs tend to be minimal. No foam inserts are required to provide adequate product protection and no glue or other adhesives are required during the assembly process. The diagonal web members at both ends of the cartons not only locate the product or products in the center of the assembled carton but also deform in the event of an impact to the end of the carton, adding considerably to crush strength. The longitudinal cut-outs in two of the cradle panels not only allow the adjacent lap panels to define the upper, central, and lower compartments within the assembled carton, but also serve to weaken those cradle panels. In this manner both the multi-compartment structure and the weakened cradle panels themselves add crush protection and stacking strength.

The longitudinal cut-outs in the cradle panels forming the central compartment may, if desired, be further shaped in a manner adapted to hold one or more products securely in place. Alternatively, other cut-outs in those cradle panels may serve that purpose. Either the upper or the lower compartment or both may be used to hold related flat materials such as instruction manuals or computer disks. Individual fold lines may be formed by creasing or, particularly between cradle panels if preferred, by the process known in the art as intermittent piercing.

The invention may be better understood from the following more detailed description of a specific embodiment, taken in the light of the accompanying drawing and the appended claims.

DETAILED DESCRIPTION

Figures 1, 2:
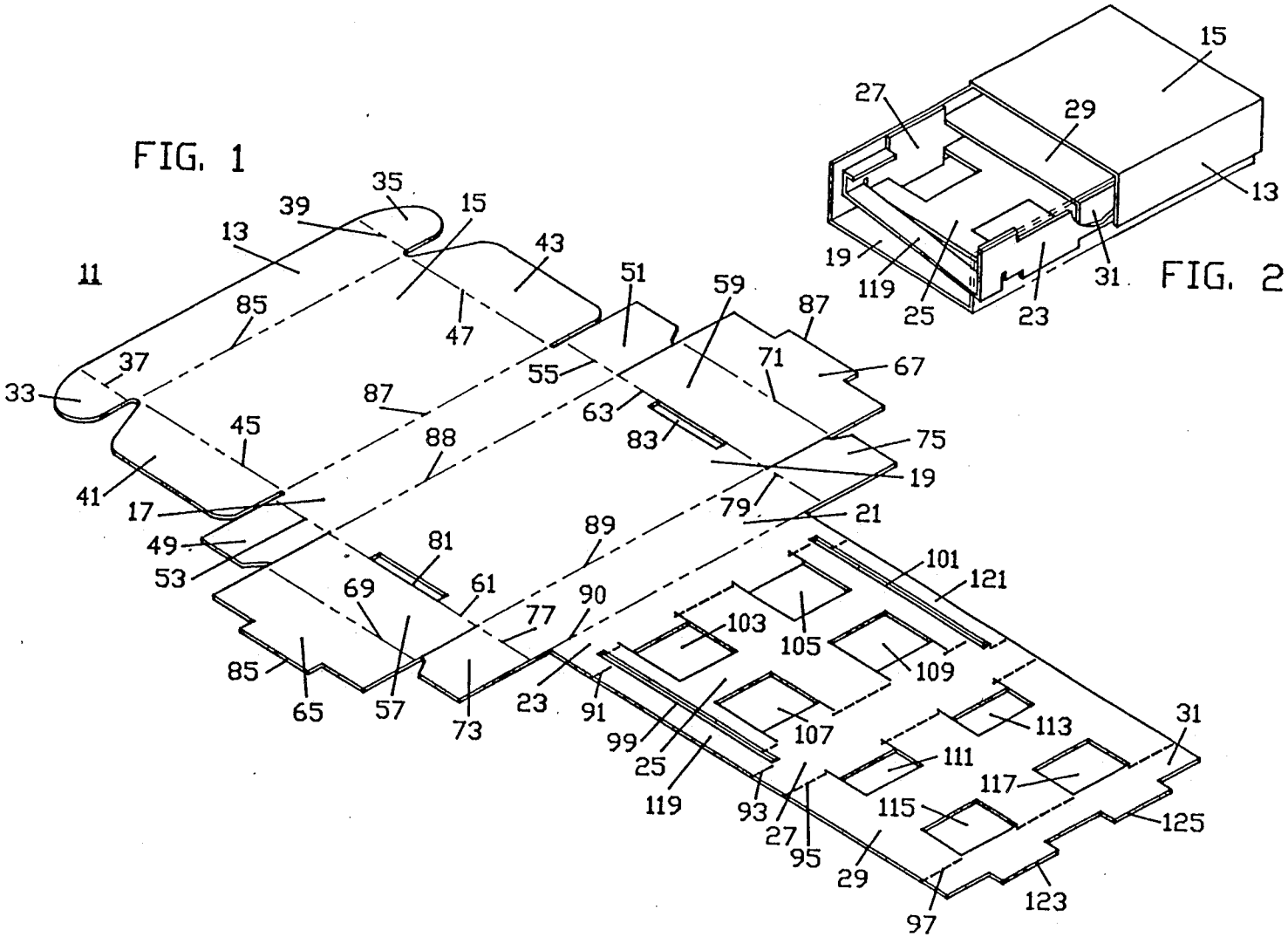
FIG. 1 is an overall view of the corrugated cardboard carton in its collapsed form prior to assembly, with sequential main parallel panels separated by longitudinal fold lines.
FIG. 2 is a partial view of an assembled carton, with portions of several outer panels removed in order to show details of the interior product cradle and one of its protecting diagonal web members.

In FIG. 1 a single corrugated cardboard blank 11 for a collapsible carton is made up of a number of parallel panels 13, 15, 17, 19, 21, 23, 25, 27, 29, and 31, each separated by a longitudinal fold line as illustrated. Of these panels, panel 13 is a lap panel, panels 17 and 21 are side panels, and panels 15 and 19 are the top and bottom panels, respectively, of the outer carton. At each end, lap panel 13 has a respective lap panel 33 and 35 separated from lap panel 13 by a respective one of lateral fold lines 37 and 39. Similarly, at each end, top panel 15 has a respective lap panel 41 and 43 separated from top panel 15 by a respective one of lateral fold lines 45 and 47. Side panel 17 has its own lap panels 41 and 43 separated from itself at each end by respective ones of lateral fold lines 53 and 55. Bottom panel 19 is different from the other outer carton panels in that it has respective end panels 57 and 59, separated from itself by respective ones of lateral fold lines 61 and 63, and further lap panels 65 and 67 separated from respective end panels 57 and 59 by respective ones of lateral fold lines 69 and 71. Lateral fold lines 69 and 71 may be double in order to accommodate the thickness of the cardboard material of the outer shipping carton.

Side panel 21 has its own lap panels 73 and 75 at each end, separated from side panel 21 by respective ones of lateral fold lines 77 and 79. Bottom panel 19 contains two lateral cut-outs 81 and 83 at each end, immediately adjacent to fold lines 61 and 63. As shown, lap panel 13 and top panel 15 are separated by a longitudinal fold line 85, top panel 15 and side panel 17 are separated by a longitudinal fold line 87, side panel 17 and bottom panel 19 are separated by a longitudinal fold line 88, and bottom panel 19 and side panel 21 are separated by a longitudinal fold line 89.

Except for panels 23, 25, 27, 29, and 31, the portion of blank 11 which has been described thus far is conventional. When the carton is assembled, lap panels 49 and 73 fold just inside of end panel 57, and lap panels 51 and 75 fold just inside of end panel 59. Lap panel 65 has an end tab 85 and folds down inside of lap panels 49 and 73, with tab 85 fitting into bottom panel cut-out 81. Lap panel 67 has a similar end tab 87 and folds down inside of lap panels 51 and 75, with tab 87 fitting into bottom panel cut-out 83. Lap panels 41 and 43 fit just inside of lap panels 65 and 67, respectively, when the carton is closed, and the carton is secured by fitting lap panels 33 and 35 into the respective gaps left between side panel 21 and the ends of end panels 57 and 59. The various fold lines separating the outer panels are formed by creasing, mostly for aesthetic reasons. Other fold lines to be described may be formed either by creasing or by the process known in the art as intermittent piercing.

The remainder of corrugated cardboard blank 11 in FIG. 1 demonstrates one arrangement embodying various aspects of the present invention in which a product supporting cradle can be formed, separating the carton interior into upper, central, and lower compartments, with diagonal web members providing additional positioning support and protection at both ends of the assembled carton. Panels 23, 25, 27, 29, and 31 are all cradle panels. The first of these, panel 23, is a cradle lap panel separated from carton side panel 21 by a longitudinal fold line 90. Fold line 90 may, if desired, be interrupted by a longitudinal cut-out. The second, panel 25, is a product supporting cradle panel separated from panel 23 by a longitudinal fold line 91. The third, panel 27, is another cradle lap panel separated from panel 25 by a longitudinal fold line 93. The fourth, panel 29, is another product supporting cradle panel separated from panel 27 by a longitudinal fold line 95. The fifth and last, panel 31, is another cradle lap panel separated from panel 29 by a longitudinal fold line 97. As an alternative to the single blank 11 illustrated in FIG. 1, longitudinal fold line 90 may be a complete break separating the blank defining the outer carton from a second blank defining the product cradle.

As illustrated in FIG. 1, product supporting cradle panels 25 and 29 contain cut-outs 99, 101, 103, 105, 107, 109, 111, 113, 115, and 117 which serve, in part, to create tabs which hold each portion of the cradle in the proper position when the carton is assembled and, in part, to weaken cradle panels 25 and 29 sufficiently to aid in the energy absorption function of the structure as a whole. In the specific embodiment of the invention shown, cut-outs 103, 105, 109, 111, 113, 115, and 117 are enlarged sufficiently to have shapes adapted for holding products to be shipped. If preferred, panels 25 and 29 may have product holding cut-outs which are independent of the cradle positioning cut-outs. The cut-outs illustrated are particularly suitable for holding electrical printed circuit boards. Separate product holding cut-outs would take entirely different shapes, of course, if the products to be shipped were to be, for example, one or more wine glasses.

In FIG. 1, cut-outs 99 and 101 are lateral cut-outs near the respective ends of product supporting panel 25. At each end of lateral cut-outs 99 and 101, fold lines 92 and 93 are displaced laterally in the same direction from the rest of their positions. Thus, at one end of cut-outs 99 and 101, the end sections of fold line 92 are displaced laterally away from the remainder of lap panel 23. At the other end of cut-outs 99 and 101, the end sections of fold line 93 are displaced laterally toward the remainder of lap panel 27. As a result, when the carton is assembled, the portion of panel 25 defined by lateral cut-out 99 and the end of supporting panel 25 nearest to it forms diagonal web member 119. Similarly, the portion of panel 25 defined by lateral cut-out 101 and the end of supporting panel 25 nearest to it forms diagonal web member 121. These diagonal web members serve not only to position the product or products within the carton but also to add significant strength to the carton. In the event of an impact to the end of the carton, either of these web members will deform and absorb energy.

Cut-outs 103 and 105 in FIG. 1 are longitudinal cut-outs in product supporting cradle panel 25 immediately adjacent to fold line 92. Cut-outs 107 and 109 are longitudinal cut-outs in product supporting cradle panel 25 immediately adjacent to fold line 93. As shown, cut-outs 103 and 107 are displaced laterally in opposite directions from their respective fold lines. Similarly, cut-outs 105 and 109 are displaced laterally in opposite directions from their respective fold lines. As a result, the remaining portions of cradle lap panels 23 and 27 form tabs which substantially match the widths of carton side panels 17 and 21, effectively raising cradle supporting panel 25 above carton bottom panel 19 to form the lower compartment in the assembled carton. This lower compartment may be either left empty to for provide energy absorption in the event of external impact or may be used to provide additional shipping space for flat items such as instruction manuals or computer disks.

Cut-outs 111 and 113 in FIG. 1 are longitudinal cut-outs in product supporting cradle panel 29 immediately adjacent to fold line 95. Cut-outs 115 and 117 are longitudinal cut-outs in product supporting cradle panel 29 immediately adjacent to fold line 97. As shown, cut-outs 111 and 113 are both displaced laterally in the same direction from their respective fold line 95. The displacement direction is toward fold line 97, making the remaining portions of cradle lap panel 27 form tabs which substantially match the width of carton side panel 17. Cut-outs 115 and 117 may, but need not be, similarly displaced from fold line 97 as long as the effective width of lap panel 31 is sufficiently small to let product supporting panel cradle 29 drop below top carton panel 15 when the carton is assembled. In the example shown in FIG. 1, this is accomplished by a final pair of tabs 123 and 125 on cradle lap panel 31, which fit into cut-outs 103 and 105. The width of the remainder of cradle lap panel 31 serves to position product supporting cradle panel 29 correctly within the assembled carton.

When the carton is assembled, product supporting cradle panels 25 and 29 thus define additional central and upper compartments. The central compartment is primarily a product holding compartment, while the upper compartment may be either left empty to provide energy absorption in the event of external impact or used to provide additional shipping space for flat items such as instruction manuals or computer disks.

FIG. 2 is a partial cross-section view of an assembled carton embodying various aspects of the invention. As shown, product supporting cradle panel 25 is raised above carton bottom panel 19, while product supporting cradle panel 29 is dropped below carton top panel 29. These positions define the respective upper, central, and lower compartments within the assembled carton. At the same time, end protection and further product positioning are provided by diagonal web member 119.

It is to be understood that the embodiment of the invention which has been described is illustrative. Numerous other arrangements and modifications may be readily devised by those skilled in the art without departing from the spirit and scope of the invention.

What is claimed is:

1. A collapsible carton of substantially rectangular cross section including outer walls and a product cradle of substantially rectangular cross section supported within said outer walls, said carton being formed from at least one blank comprising adjacent parallel panels separated by parallel longitudinal fold lines and including at least four successive outer wall panels, two of said outer wall panels forming respective top and bottom panels characterized in that said cradle divides the assembled carton into respective upper, central, and lower compartments and is separated from said top and bottom panels of said carton by stand-off tabs formed by portions of at least two opposite walls of said cradle which extend beyond the periphery of said cradle, at least said central compartment being adapted to hold a product and said upper and lower compartments providing top and bottom protection for the contents of said cradle and additional usable storage space.

2. A collapsible carton in accordance with claim 1 further characterized in that a pair of diagonal web members extend across both ends of said cradle between said cradle and the respective ends of the assembled carton, both to position the contents of said cradle within said carton and to provide end protection for the contents of said cradle.

3. A collapsible carton in accordance with claim 2 further characterized in that a blank includes a succession of at least five parallel cradle panels separated by respective longitudinal fold lines, a first of said cradle panels is a lap panel for assembly in a position adjacent to one of said outer wall panels, a second of said cradle panels is a product supporting panel adjacent to said first cradle panel, a third of said cradle panels is a lap panel adjacent to said second cradle panel, a fourth of said cradle panels is a product supporting panel adjacent to said third cradle panel, the fifth of said cradle panels is a lap panel adjacent to said fourth cradle panel, one of said second and fourth cradle panels has a pair of lateral cut-outs running parallel to each other and substantially perpendicular to said fold lines at predetermined distances from opposite ends of the panel, and the portions of said fold lines extending from each of said lateral cut-outs to the ends of the panel containing them are displaced in the same direction from but are substantially parallel to the remaining portions of said fold lines, enabling the end portions of the panel to form said diagonal web members at both ends of the carton in its assembled form.

4. A collapsible carton in accordance with claim 3 further characterized in that said outer wall panels and said cradle panels are all formed from a single blank.

5. A collapsible carton in accordance with claim 2 further characterized in that a blank includes a succession of at least five parallel cradle panels separated by respective longitudinal fold lines, a first of said cradle panels is a lap panel for assembly in a position adjacent to one of said outer wall panels, a second of said cradle panels is a product supporting panel adjacent to said first cradle panel, a third of said cradle panels is a lap panel adjacent to said second cradle panel, a fourth of said cradle panels is a product supporting panel adjacent to said third cradle panel, the fifth of said cradle panels is a lap panel adjacent to said fourth cradle panel, said second cradle panel contains longitudinal cut-outs extending parallel and adjacent to the fold lines between it and said first and third cradle panels, portions of both fold lines of said second cradle panel extending between said longitudinal cut-outs are displaced in opposite directions from but are parallel to the remaining portions of said fold lines, making the width of said second cradle panel defined by said longitudinal cut-outs less than the width of the corresponding outer wall panels and spacing said second cradle panel from one of the outer wall panels when the carton is in its assembled form, said fourth cradle panel contains longitudinal cut-outs extending parallel and adjacent to the fold lines between it and said third and fifth cradle panels, portions of at least one of the fold lines of said fourth cradle panel extending between said linear cut-outs are displaced from but are parallel to the remaining portions of said fold line, spacing said fourth cradle panel from one of the outer wall panels when the carton is in its assembled form, said second and fourth cradle panels define said upper, central, and lower compartments within the carton in its assembled form, one of said second and fourth cradle panels has a pair of lateral cut-outs running parallel to each other and substantially perpendicular to said fold lines at predetermined distances from opposite ends of the panel, and the portions of said fold lines extending from each of said lateral cut-outs to the ends of the panel containing them are displaced in the same direction from but are substantially parallel to the remaining portions of said fold lines, enabling the end portions of the panel to form said diagonal web members at both ends of the carton in its assembled form.

6. A collapsible carton in accordance with claim 5 further characterized in that said outer wall panels and said cradle panels are all formed from a single blank.

7. A collapsible carton in accordance with claim 5 further characterized in that said second cradle panel contains said pair of lateral cutouts.

8. A collapsible carton in accordance with claim 7 further characterized in that the fold lines adjacent said outer wall panels are formed by creasing.

9. A collapsible carton in accordance with claim 7 further characterized in that the fold lines adjacent said outer wall panels are formed by creasing and the remaining fold lines are formed by intermittent piercing.

10. A collapsible carton in accordance with claim 1 further characterized in that a blank includes a succession of at least five parallel cradle panels separated by respective longitudinal fold lines, a first of said cradle panels is a lap panel for assembly in a position adjacent to one of said outer wall panels, a second of said cradle panels is a product supporting panel adjacent to said first cradle panel, a third of said cradle panels is a lap panel adjacent to said second cradle panel, a fourth of said cradle panels is a product supporting panel adjacent to said third cradle panel, the fifth of said cradle panels is a lap panel adjacent to said fourth cradle panel, said second cradle panel contains longitudinal cut-outs extending parallel and adjacent to the fold lines between it and said first and third cradle panels, portions of both fold lines of said second cradle panel extending between said longitudinal cut-outs are displaced in opposite directions from but are parallel to the remaining portions of said fold lines, making the width of said second cradle panel defined by said longitudinal cut-outs less than the width of the corresponding outer wall panels and spacing said second cradle panel from one of the outer wall panels when the carton is in its assembled form, said fourth cradle panel contains longitudinal cut-outs extending parallel and adjacent to the fold lines between it and said third and fifth cradle panels, portions of at least one of the fold lines of said fourth cradle panel extending between said linear cut-outs are displaced from but are parallel to the remaining portions of said fold line, spacing said fourth cradle panel from one of the outer wall panels when the carton is in its assembled form, and said second and fourth cradle panels define said upper, central, and lower compartments within the carton in its assembled form.

11. A collapsible carton in accordance with claim 3 further characterized in that said outer wall panels and said cradle panels are all formed from a single blank.

* * * * *